United States Patent [19]

Kando

[11] Patent Number: 4,592,135

[45] Date of Patent: Jun. 3, 1986

[54] APPARATUS FOR AUTOMATICALLY CLOSING A SLIDE FASTENER

[75] Inventor: Akiyoshi Kando, Uozu, Japan

[73] Assignee: Yoshida Kogyo K. K., Tokyo, Japan

[21] Appl. No.: 731,739

[22] Filed: May 8, 1985

[30] Foreign Application Priority Data

May 11, 1984 [JP] Japan ..... 59-68675[U]

[51] Int. Cl.[4] ..... A41H 37/06

[52] U.S. Cl. ..... 29/766; 29/33.2

[58] Field of Search ..... 29/33.2, 408–410, 29/766–770

[56] References Cited

U.S. PATENT DOCUMENTS 4,365,403 12/1982 Ooura ..... 29/408
4,369,560 1/1983 Ueda ..... 29/408
4,392,291 7/1983 Iai ..... 29/408

FOREIGN PATENT DOCUMENTS 51-9361 3/1976 Japan .
54-41939 12/1979 Japan .
54-41940 12/1979 Japan .

*Primary Examiner*—Howard N. Goldberg
*Assistant Examiner*—Steven Nichols
*Attorney, Agent, or Firm*—Hill, Van Santen, Steadman & Simpson

[57] ABSTRACT

An apparatus for automatically closing a slide fastener with two rows of partly interengaged coupling elements, comprises a conveyor for feeding the slide fastener, a holder for temporarily arresting the movement of the slide fastener on the conveyor, and a driver for moving a slider in a fastener closing direction to fully close the slide fastener while the latter is being held in position by the holder. The holder and the driver are supported on opposite ends of an elongate support frame disposed above the conveyor. An actuator is connected to the support frame for reciprocating the latter with respect to the conveyor to bring the holder into and out of engagement with the slide fastener. The apparatus thus constructed is simple in construction, easy to adjust and maintain, and reliable in operation.

8 Claims, 3 Drawing Figures

APPARATUS FOR AUTOMATICALLY CLOSING A SLIDE FASTENER

BACKGROUND OF THE INVENTION

1. Field of the Invention

The present invention relates to an apparatus for automatically closing a slide fastener before the latter is packaged for delivery to the market.

2. Prior Art:

There are known apparatus for automatically closing a slide fastener having two rows of partly interengaged coupling elements before the slide fastener is packaged. One known closing apparatus includes a holder means such as an endless roller or a stopper bail for holding a slider, and a drawer means such as a drive roller or a reciprocable gripper for threading the stringer tapes through the slider so as to fully close the slide fastener while the slider is held immovable. Another known closing apparatus has a presser roll for holding stringer tapes, and a drawing finger for threading a slider over the stringer tapes until the slide fastener is fully closed. Japanese Utility Model Publication No. 51-9361, published Mar. 12, 1976 and Japanese Patent Publication Nos. 54-41939 and 54-91940, both published Dec. 11, 1979 are believed to disclose such prior closing apparatus. According to the disclosed apparatus, the holder means is structurally and operationally independent from the drawer means. The prior closing apparatus having such independent means are difficult to adjust and hence operate unreliably, and are not easy to maintain.

SUMMARY OF THE INVENTION

It is an object of the present invention to provide an apparatus for automatically closing a slide fastener, which apparatus is reliable in operation and is easy to adjust and maintain.

According to the present invention, an apparatus for automatically closing a slide fastener with two rows of partly interengaged coupling elements, comprises a conveyor for carrying the slide fastener, a holder for temporarily arresting the movement of the slide fastener on the conveyor, a drive means for moving a slider in a fastener closing direction to fully close the slide fastener while being held in position by the holder. The holder and the slider-driving means are supported on opposite ends of an elongate support frame which is disposed above the conveyor and is connected to an actuator for reciprocation with respect to the conveyor to bring the holder into and out of engagement with the slide fastener.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
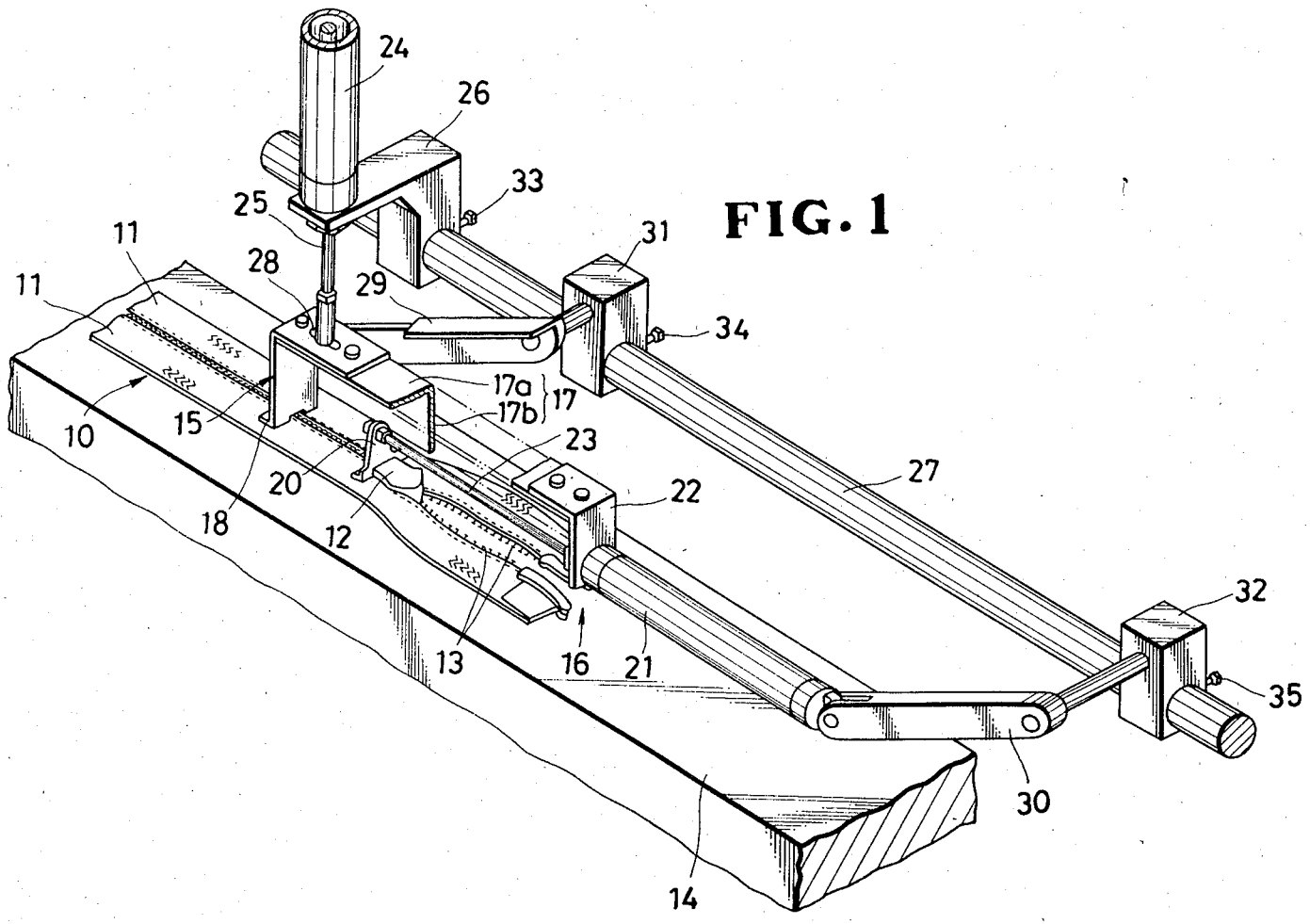
FIG. 1 is a fragmentary perspective view, partly cut away, of an apparatus according to the present invention.

FIG. 1 shows an apparatus, constructed in accordance with the present invention, for automatically closing a slide fastener 10 which includes a pair of stringer tapes 11, 11 and a slider 12 slidably mounted on two rows of partly interengaged coupling elements 13, 13 supported on the stringer tapes 11, 11 along inner longitudinal edges thereof.

The apparatus generally comprises a horizontal conveyor 14 for carrying the slide fastener 10 along a longitudinal path, a holder 15 for temporarily arresting the movement of the slide fastener 10 in a predetermined position on the conveyor 14, and a drive means 16 for moving the slider 12 in a fastener closing direction along the rows of coupling elements 13, 13 to fully close the slide fastener 10, the holder 15 and the drive means 16 being supported on opposite ends of an elongate support frame 17 disposed above the conveyor 14 in parallel relation thereto. The support frame 17 comprises an angled beam having a horizontal wing **17*a* and a vertical wing 17*b*** joined at one longitudinal edge.

The holder 15 has an L-shaped configuration constituted by a horizontal portion secured to the horizontal wing **17*a* of the support frame 17 by a pair of screws and a vertical portion extending downwardly from the horizontal portion. The vertical portion terminates in a horizontal presser foot 18 engageable with the stringer tapes 11, 11 to retain the slide fastener 10 in the predetermined position on the conveyor 14 while the slider 12 is threaded over the coupling elements 13 by means of the drive means 16**.

The drive means 16 includes a vertical drive bail 20 disposed between the opposite ends of the support frame 17 in lateral alignment with the vertical plate of the holder 15, and a first actuator such as a fluid-actuated cylinder 21 mounted on the support frame 17 via an L-shaped bracket 22 which is secured to the other end of the support frame 17 by a pair of screws. The cylinder 21 extends parallel to the support frame 17 in a direction away from the holder 15. The drive bail 20 is detachably connected to the distal end of a piston rod 23 of the cylinder 21. The piston rod 23 is normally extended as shown in FIG. 1, and upon operation of the cylinder 21, it is retracted to move the drive bail 20 in a direction away from the holder 15 along the rows of coupling elements 13.

The apparatus further includes a second actuator such as a fluid-actuated cylinder 24 having a piston rod 25 connected to the support frame 17 for reciprocating the latter with respect to the conveyor 14. The cylinder 24 is mounted on a support block 26 slidably mounted on a fixed horizontal guide bar 27 extending along the conveyor 14. The horizontal portion of the holder 15 and the horizontal wing **17*a* of the support frame 17 have a pair of aligned oblong holes 28 (only one being shown in FIG. 1) extending longitudinally of the support frame 17. The piston rod 25 extends loosely through the oblong holes 28 and is relatively movably connected to the support frame 17. The piston rod 25 is connected to the support frame 17 at a position adjacent to the holder 15 so as to transfer a thrusting force of the cylinder substantially directly to the presser foot 18 for reliable holding of the slide fastener. The piston rod 25** is normally retracted and, upon actuation of the cylinder 24, it extends to move the support frame 17 toward the conveyor 14.

A pair of connecting levers 29, 30 is pivotably connected at one end to a pair of support blocks 31, 32 slidably mounted on the guide bar 27. The other end of the connecting lever 29 is pivotably connected to the end of the support frame 17 adjacent to the holder 15. Likewise, the other end of the connecting lever 30 is pivotably connected to the rear end of the cylinder 21. With the connecting levers 29, 30 thus arranged, the support frame 17 is horizontally reciprocable within the longitudinal extent of the oblong holes 28 in response to vertical reciprocating movement of the piston rod 25 of the cylinder 24. The support blocks 26, 31, 32 are secured to the guide bar 27 by screws 33, 34, 35, respectively, and they are positionally adjustable to accomodate to the change of length of the slide fasteners to be processed by the apparatus while the screws 33–35 are loosened.

Figure 2:
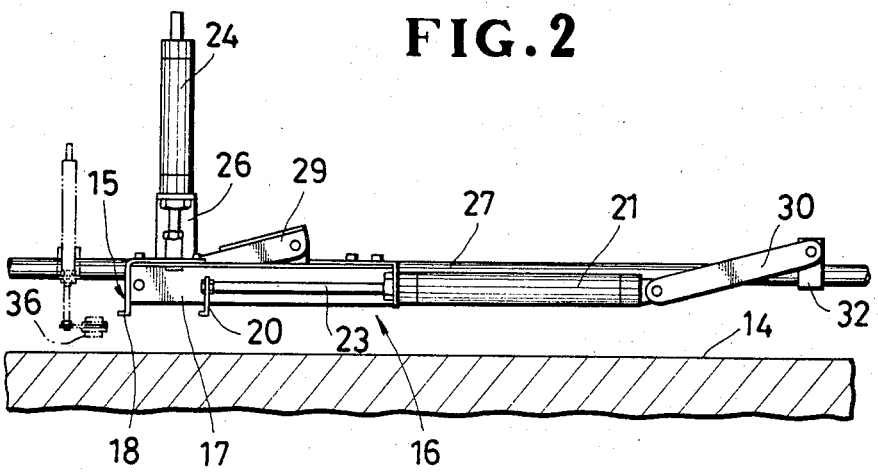
FIG. 2 is a front elevational view of the apparatus shown in FIG. 1, with parts in an elevated position.
Figure 3:
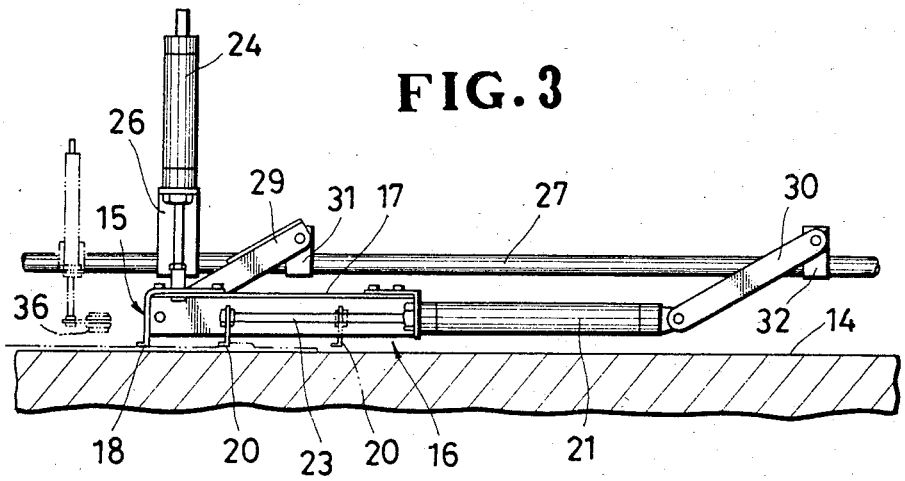
FIG. 3 is a view similar to FIG. 2, showing parts in a lowered position.

As shown in FIGS. 2 and 3, a sensor such as a photoelectrioc sensor 36 is disposed downstream of the holder 15 for detecting the arrival of the slider 12 of the slide fastener 10 at a position below the sensor 36. The sensor 36 is connected in circuit with the cylinder 24 via a time switch (not shown). The time switch is set or started when the sensor 36 detects the arrival of the slider 12 of the slide fastener 10, and at a predetermined interval of time after its setting, it energizes the cylinder 24 to extend the piston rod 25. The time interval is selected such that the detected slider 12 has advanced slightly beyond the bail 20 after its arrival at the position below the sensor 36.

In operation, the slide fasteners are supplied from a fastener processing machine (not shown) one by one onto the conveyor 14 with their separated or open end directed forwardly. Upon energization of the fastener closing apparatus, the conveyor 14 is driven to feed the slide fasteners toward the holder 15. During that time, the cylinder 24 remains de-energized to keep the support frame 17 away from the conveyor 14, as shown in FIG. 2. When the slider 12 on the leading slide fastener 10 passes below the sensor 36, the sensor 36 sends an electric signal to the time switch to set or start the latter. The time switch, at a predetermined interval of time after its setting, energizes the cylinder 24 to move the support frame 14 downwardly toward the conveyor 14. Downward movement of the support frame 17 causes the presser foot 18 to engage the stringer tapes 11, 11 to arrest the movement of the slide fastener 10 without hindering the movement of the conveyor 14. Thus, the slide fastener 10 is temporarily held in the predetermined position shown in FIGS. 1 and 3 in which the drive bail 20 is located immediately upstream of the slider 12 of the slide fastener 10. Then the cylinder 21 is actuated to retract the piston rod 23 whereupon the drive bail is caused to slide the slider 12 in a fastener closing direction along the coupling elements 13 until the slide fastener 10 is fully closed. Thereafter, the cylinder 24 is actuated to move the support frame 17 upwardly away from the slide fastener 12, thereby allowing the slide fastener 12 to advance along the conveyor 14. The cylinder 21 is actuated to extend the piston rod 22.

As the holder 15 and the drive means 16 are interconnected as a single unit by the support frame 17, the fastener closing apparatus is simple in construction, is easy to adjust and maintain, and is reliable in operation.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for automatically closing a slide fastener having a slider slidably mounted on two rows of partly interengaged coupling elements supported on stringer tapes along inner longitudinal edges thereof, the apparatus comprising:

(a) a conveyor for carrying the slide fastener along a longitudinal path;

(b) a holder for temporarily holding the slide fastener in a position on said conveyor;

(c) a drive means for moving the slider in a fastener closing direction along the rows of coupling elements to thereby fully close the slide fastener while the slide fastener is held in said position;

(d) an elongated support frame disposed above said conveyor in parallel relation to the latter and having one end supporting said holder and the other end supporting said drive means; and (e) an actuator connected to said support frame for reciprocating the latter toward and away from said conveyor to bring said holder into and out of engagement with the slide fastener.

2. An apparatus according to claim 1, said holder including a presser foot engageable with the stringer tapes for temporarily arresting the movement of the slide fastener at said predetermined position.

3. An apparatus according to claim 1, said drive means comprising a drive bail, disposed below said support frame and movable between said ends of said support frame, and an actuator mounted on said other end of said frame and operatively connected to said drive bail to reciprocate the latter along said longitudinal path.

4. An apparatus according to claim 3, said last-named actuator comprising a fluid-actuated cylinder having a piston rod with an end reciprocably movable between said ends of said frame, said piston rod end being connected to said drive bail.

5. An apparatus according to claim 1, said actuator comprising a fluid-actuated cylinder having a piston rod connected to said support frame.

6. An apparatus according to claim 5, said piston rod being connected to said support frame adjacent to said one end of said support frame.

7. An apparatus according to claim 6, including a pair of connecting levers pivotably connected at one end to said guide bar, the other end of one of said connecting levers being pivotably connected to said one end of said support frame, the other end of the other connecting lever being pivotably connected to said driving means, said support frame having a longitudinal oblong hole adjacent to said one end thereof, said actuator comprising a fluid-actuated cylinder having a piston rod connected through said of long hole to said support frame adjacent to said one end of said support frame.

8. An apparatus according to claim 1, including a fixed guide bar extending parallel to said conveyor, said actuator being positionally adjustably mounted on said guide bar and movable along said guide bar.

* * * * *